United States Patent [19]

Barkus et al.

[11] Patent Number: 4,671,584

[45] Date of Patent: Jun. 9, 1987

[54] ELECTRICAL POWER CONNECTOR

[75] Inventors: Lee A. Barkus, Millersburg; Matthew M. Sucheski, Harrisburg, both of Pa.

[73] Assignee: AMP Incorporated, Harrisburg, Pa.

[21] Appl. No.: 857,205

[22] Filed: Apr. 29, 1986

[51] Int. Cl.[4] ..... H01R 9/09; H01R 13/436; H01R 19/28

[52] U.S. Cl. ..... 439/78; 439/682; 439/844

[58] Field of Search ..... 339/17 C, 17 LC, 191 R, 339/191 M, 192 R, 192 RL, 258 R, 258 P, 258 F

[56] References Cited

U.S. PATENT DOCUMENTS

| | | | |
|---|---|---|---|
| 3,061,761 | 10/1962 | Blain | 361/413 |
| 3,192,498 | 6/1965 | Ruehlemann | 339/258 R |
| 3,470,421 | 9/1969 | Shore et al. | 339/17 L |
| 3,566,341 | 2/1971 | Skony | 339/192 RL |
| 4,030,792 | 6/1977 | Fuerst | 339/17 LC |
| 4,175,811 | 11/1979 | Coldren et al. | 339/191 M |
| 4,387,950 | 6/1983 | Guzik et al. | 339/17 LC |
| 4,451,107 | 5/1984 | Dola et al. | 339/143 R |
| 4,487,464 | 12/1984 | Kirschenbaum | 339/19 |

*Primary Examiner*—Neil Abrams

*Attorney, Agent, or Firm*—Allan B. Osborne

[57] ABSTRACT

An electrical power connector for conducting electrical power from a power bus bar to a circuit card. More particularly, the connector includes contact elements having tab terminal receiving receptacles positioned in a dielectric housing in a staggered arrangement so that the forces requires to insert tab terminals into the receptacles are distributed. Further, the terminal-receiving space in each receptacle is defined by a stationary member on one side and dual side-by-side spring-biased members on the other side so that the force required to insert a tab terminal therein is initially incremental.

2 Claims, 16 Drawing Figures

ELECTRICAL POWER CONNECTOR

FIELD OF THE INVENTION

The present invention relates to electrical power connectors which provide a conduit for power from a power bus bar to a printed circuit card.

BACKGROUND OF THE INVENTION

Bringing power to circuit cards mounted in racks or card cages always presents problems from the standpoint of accessibility of the cards. Where the cards are mounted in card edge connectors on a back panel, heavy duty contacts in the card edge connectors transfer power from the panel to the cards. In the absence of card edge connectors or the like, it has been the practice in the field to jury-rig means for energizing the cards. In one such instance, three elongated rods are employed with the rods spaced from each other and supported, one over the other, by frames. One end of each rod is threaded to be received in a threaded contact pad in a back panel. The other end of each rod has a hex head for turning the rod with a wrench. Aligned straps, mounted on the rods adjacent the threaded end are forced against the contact pad for electrical connection therewith when the rods are threaded into holes in the pad centers. The straps, having pins on the free ends for being received and secured in holes in the card, and the card cannot turn with the rods. This requirement forced the rods to be loosely passed through holes in the straps with stop means, e.g. a nut on the rod behind the strap, to force the straps against the contact pads as the rods are threaded thereinto. Further, the upper two rods must pass through the straps extending up from the lowest and middle positioned rods. Thus, in order to electrically isolate a strap, the rods must be nonconductive or rubber bushings must be positioned in the holes in the straps. As is apparent, the above-described power system includes a large number of components, is awkward to use, and cannot be easily modified. Further, the power system is not readily movable with a card attached thereto.

It is therefore desirable to provide an electrical connector which would be simple to install and use, have few components which are inexpensively made, have versatility, and can be moved with ease with an attached card.

SUMMARY OF THE INVENTION

According to the present invention, an electrical power connector is provided having a housing of dielectrical material and one or more contact elements therein. Each contact element includes a receptacle for receiving a tab terminal on a power bus bar or the like, and pins for engaging a circuit card whereby power from the tab terminal may be conducted through the contact element into conductive traces on the card. The tab terminal receiving space in the receptacle is defined by a stationary wall on one side and a pair of side-by-side, spring-biased members on the opposite side. The dual spring-biased members stagger the force required to insert a tab terminal therein without reducing the total compressive force exerted against an inserted terminal. Insertion force is further staggered by providing staggered locations for two or more contact elements in the housing. The circuit card engaging pins on two or more contact elements in a single housing are positioned at the ends of straps which include vertical and horizontally displaced intermediate sections so that the pins, which project from the housing, are on a precise, aligned pattern required by the circuit card.

DESCRIPTION OF THE INVENTION

Figure 1:
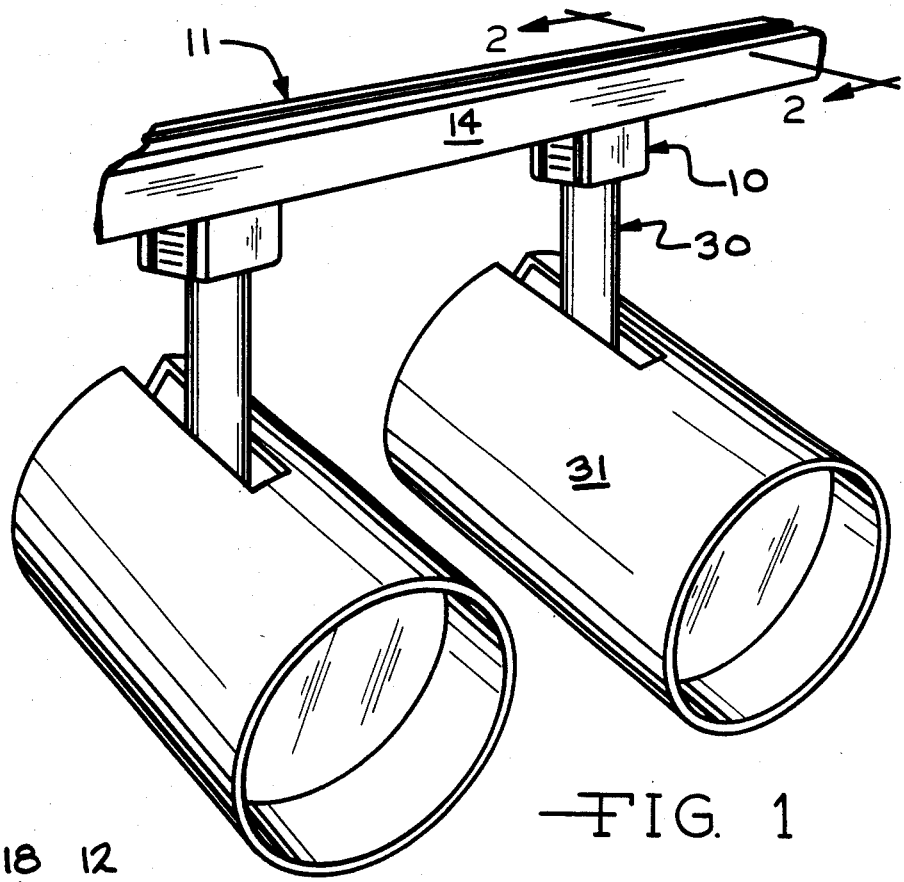
FIG. 1 is an exploded, perspective view of the electrical power connector of the present invention showing the components thereof.
Figure 2:
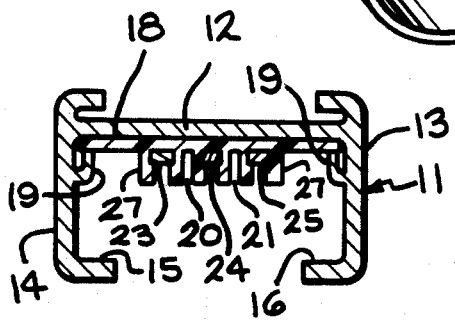
FIG. 2A is a front plan view of the housing of the connector.
FIG. 2B is a perspective view of the inside surface of the cover of the housing.

FIG. 1 illustrates, in exploded fashion, the preferred embodiment of connector 10 of the present invention. Connector 10 includes housing 12, cover 14, and contact elements 16, 18 and 20. Housing 12 and cover 14 are preferably molded from a suitable dielectric material such as glass-filled nylon. Contact elements 16, 18, 20 are preferably stamped and formed from a half-hardened copper alloy having desired spring characteristics.

Contact element receiving cavities 22, 24 and 26, provided in housing 12, are L-shaped, having receptacle sections 28, 30 and 32 respectively which are parallel to housing side surfaces 34, 36 and lateral passages 38, 40 and 42 respectively which are generally parallel to top and bottom surfaces 44, 46 respectively of housing 12.

Figure 2A:
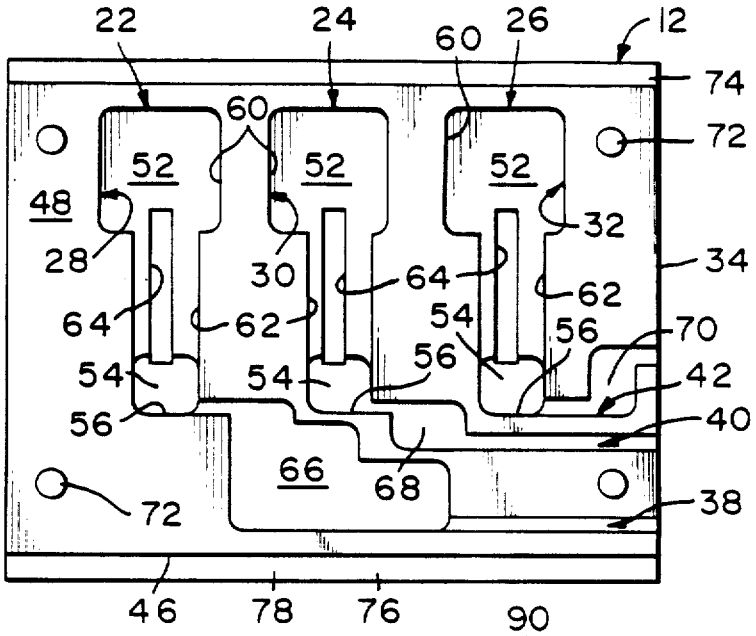

With reference to FIGS. 1 and 2A, receptacle sections 28, 30, 32 have a squarish keyhole shape and extend into housing 12 from front surface 48 thereof, terminating short of rear surface 50. The distance each section 28, 30, 32 extends into housing 12 differs as shown in the cross-sectional view of housing 12 in FIG. 3. Section 30 is short, section 28 is long, and section 32 has a depth intermediate the other two.

As shown in FIG. 2A, rear wall 52 of each section 28, 30, 32 includes recess 54 which extends upwardly from section floors 56.

As noted above, receptacle sections 28, 30 and 32 have a keyhole shape with a wide, slightly nonsymmetrical, upper portion 60 and narrow lower portion 62.

Figure 3:
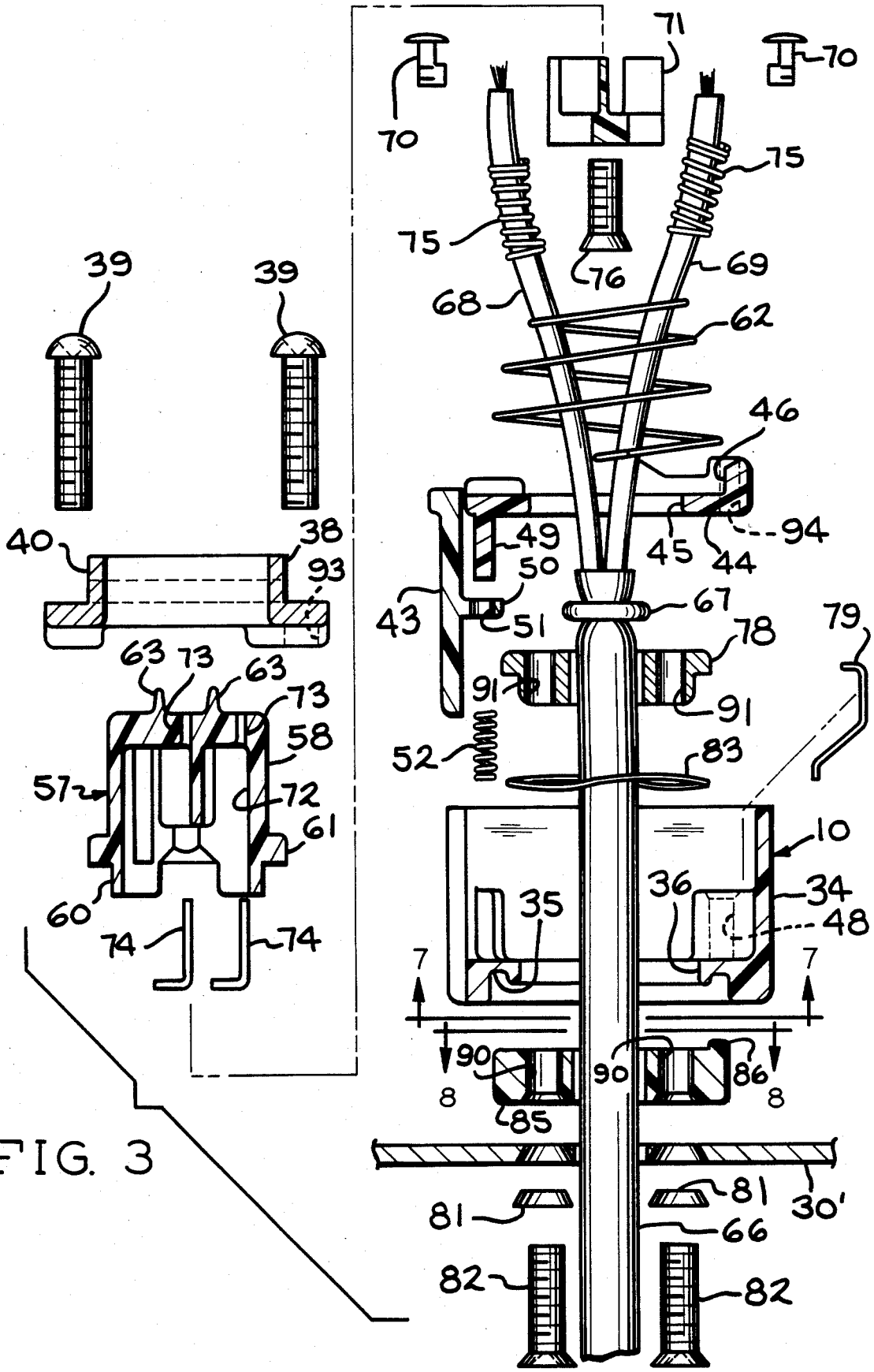
FIG. 3 is an exploded, cross-sectional, top plan view of the electrical power connector.
Figure 4:
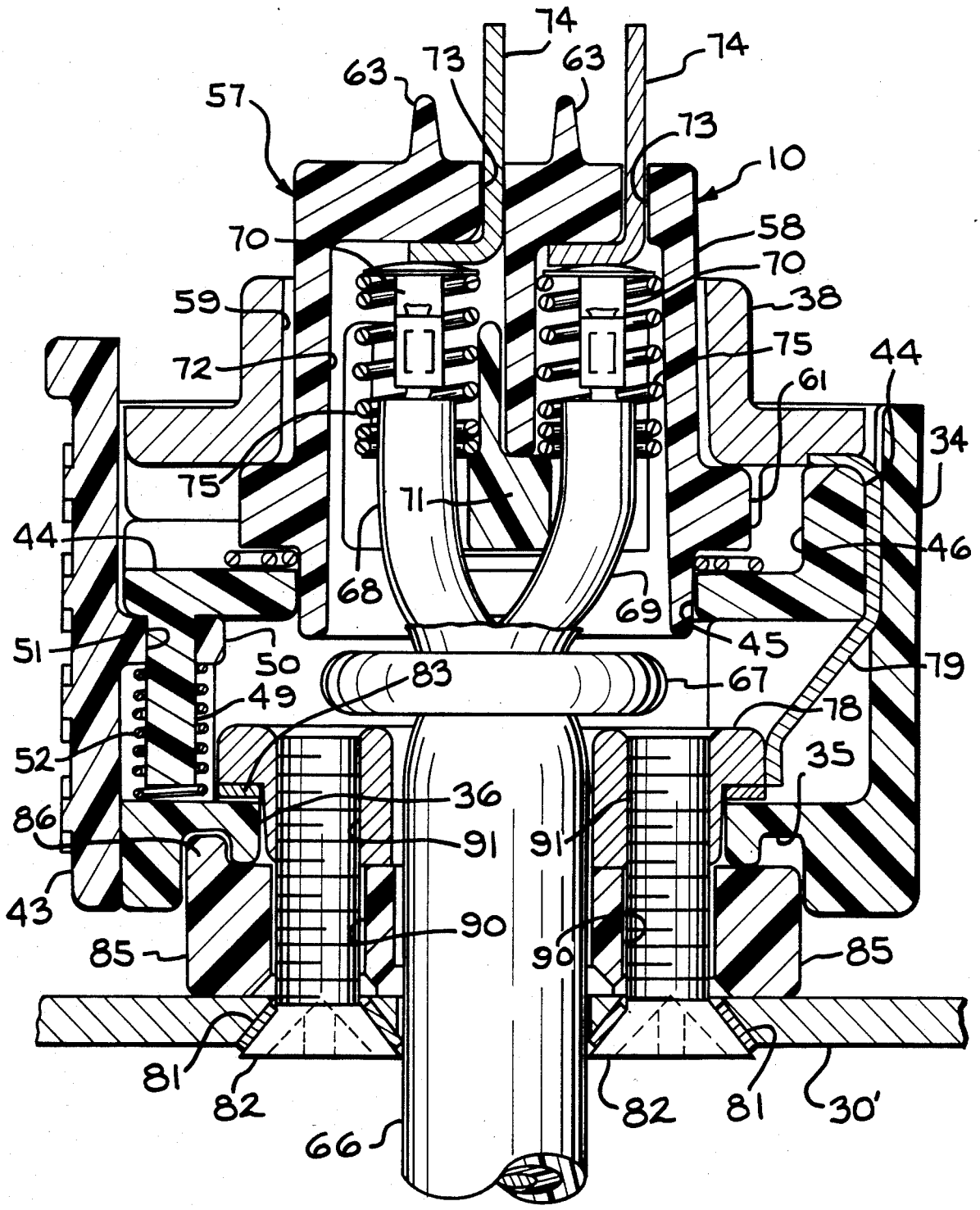
FIG. 4A is a side plan view of a contact element of the connector.
FIG. 4B is a perspective view of the contact element of FIG. 4A.

As shown in FIGS. 2A and 3, passages 64, opening out on rear surface 50, provide access to receptacle sections 28, 30, 32 from that surface of housing 12.

With reference to FIG. 2A, lateral passages 38, 40, 42 of respective cavities 22, 24, 26 extend from receptacle sections 28, 30, 32 respectively to and open out on side surface 34 of housing 12. Each lateral passage 38, 40, 42 includes an enlarged intermediate portion 66, 68 and 70 respectively. As shown, passages 38, 40, 42 intersect respective receptacle sections 28, 30, 32 on level with floors 56.

As shown in phantom in FIG. 3, passages 38, 42 extend back to wall 52 in receptacle sections 28, 32 respectively, and passage 40 extends back to recess 54 in receptacle section 30.

Figure 9:
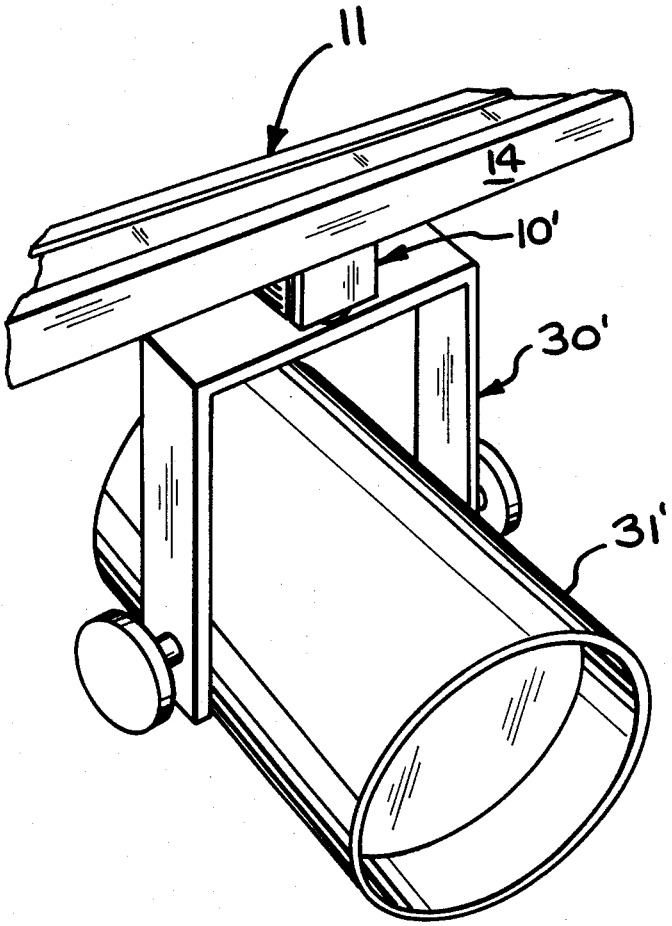
FIG. 9 is a cross-sectional top plan view of the connector taken along line 9—9 in FIG. 11.
Figure 1:
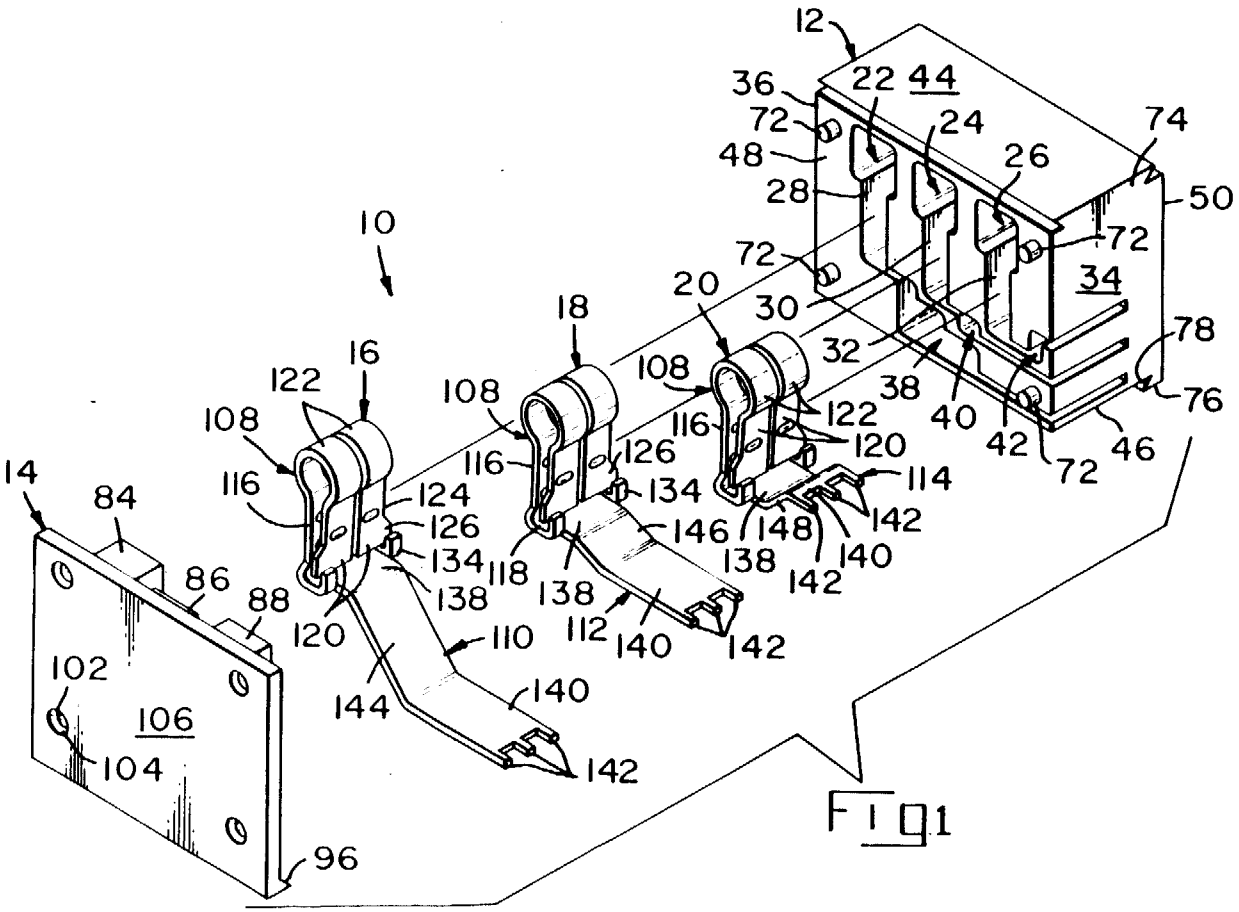

As shown in FIG. 1, four studs 72 project outwardly from front surface 48 of housing 12. These studs are used to secure cover 14 to housing 12 by being deformed in a known manner as shown in FIG. 9. Alternatively, studs 72 could be replaced with threaded apertures (not shown) and cover 14 removably attached to housing 12 by machine screws (not shown).

Figure 11:
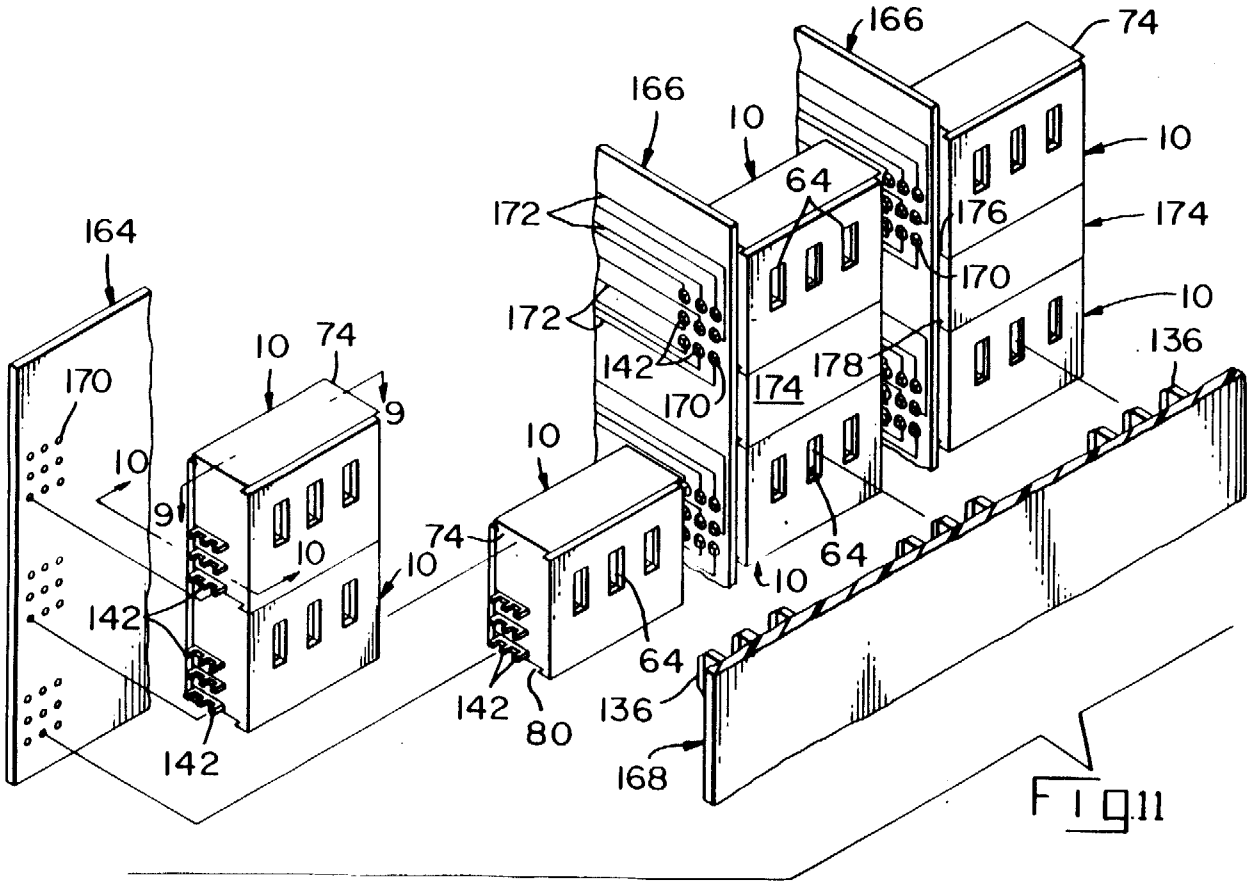
FIG. 11 is a perspeective view showing one usage of the electrical power connectors.

Top portion 74 of housing 12 is keystone shaped to enable connectors 10 to be stacked on top of one another as shown in FIG. 11.

With reference to FIG. 1, depending bar 76 extends across the length of housing 12 on bottom surface 46 and has a slanting inside surface 78.

Figure 2B:
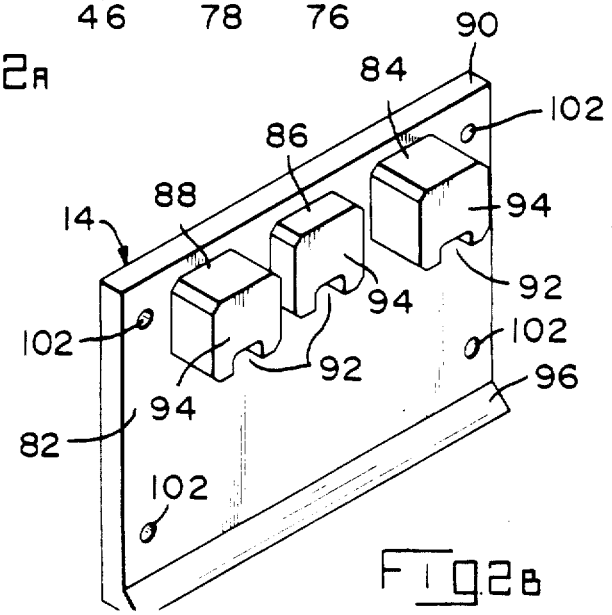
Figure 3:
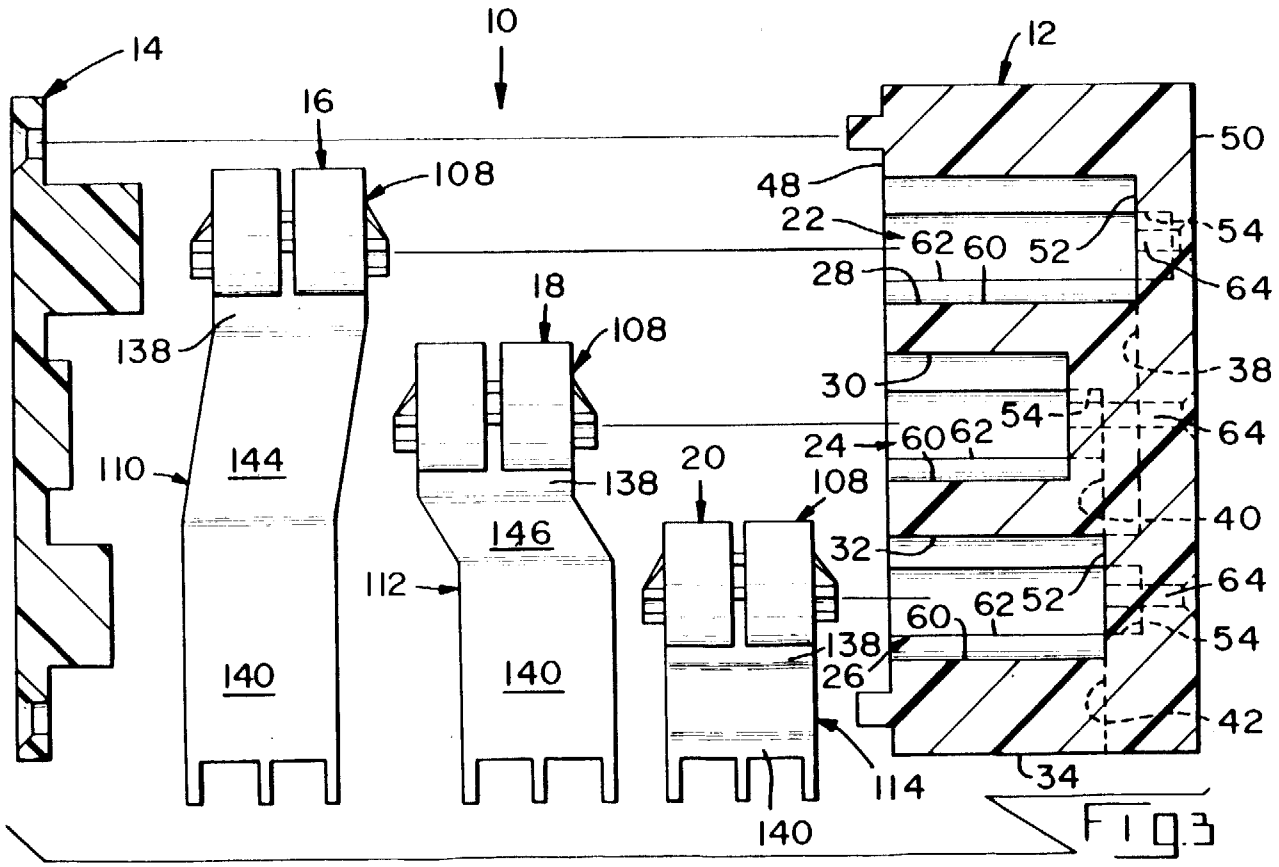

With reference to FIG. 2B and cover 14, inside surface 82 thereof includes three spaced-apart bosses 84, 86, 88 located near upper edge 90. Bosses 84, 86 and 88 have a squarish shape in cross section which complements the shape of upper portions 60 of receptacle sections 28, 30, 32 in housing 12. A downwardly open groove 92 is provided in each boss 84, 86, 88 and extends from free end faces 94 thereof back to inside surface 82. The length of each boss varies with boss 86 being the shortest, boss 84 being the longest, and boss 88 being of an intermediate length. As will be seen, the boss lengths complement the depths of receptacle sections 28, 30, 32 which receive bosses 84, 86, 88 respectively when cover 14 is placed on housing 12.

Figure 10:
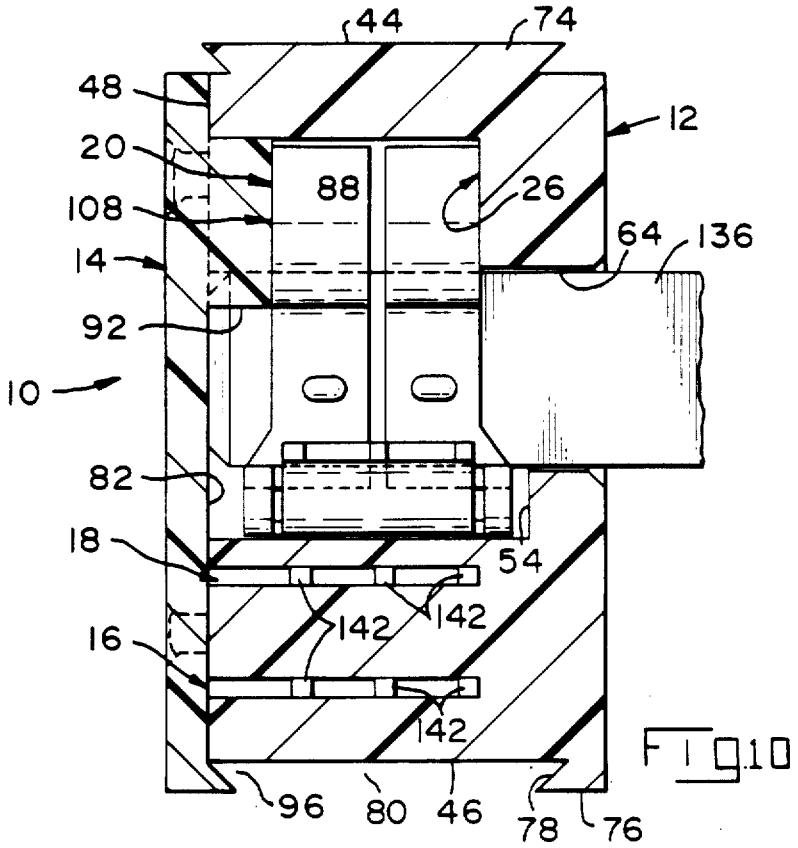
FIG. 10 is a cross-sectional side view of the connector taken along line 10—10 in FIG. 11.

A downwardly slanted surface 96, extending outwardly from inside surface 82, is provided adjacent lower edge 98 of cover 14. Surface 96, in cooperation with bottom surface 46 and slanted surface 78 when cover 14 is placed on housing 12, forms an asymmetrical keystone-shaped slot 80 (FIG. 10).

As shown in FIG. 1, four stud-receiving holes 102 extend through cover 14 and include tapered counterbores 104 extending to outside surface 106.

Dimensionally, cover 14 is as long as housing 12 and is sufficiently wider so that surface 96 extends below bottom surface 46 when the two are placed together.

With reference to FIG. 1, contact elements 16, 18 and 20 include identical keyhole-shaped receptacles 108 and slightly different straps 110, 112 and 114 respectively.

Receptacles 108 each include a stationary member 116 extending up from one side of floor 118, two movable members 120, and two spring members 122.

Figure 4B:
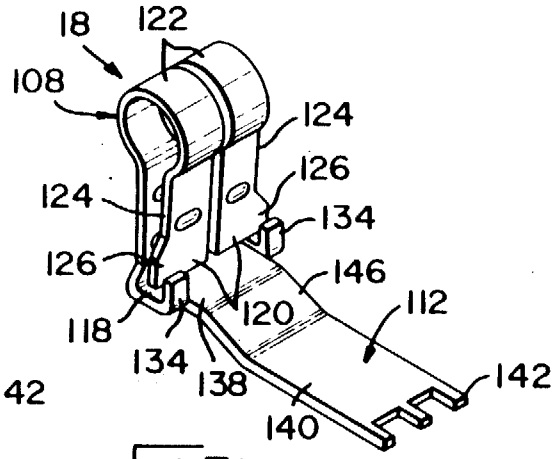
Figure 4A:
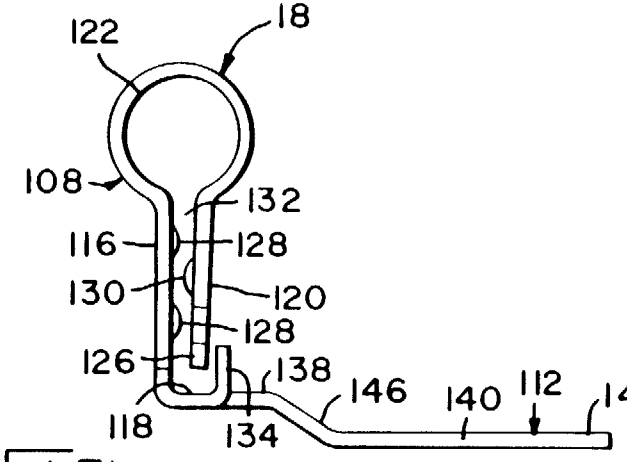
Figure 5:
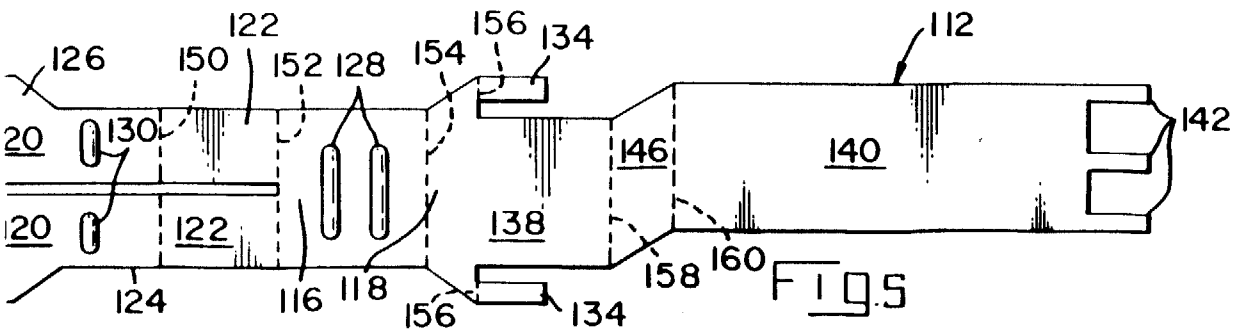
Figure 6:
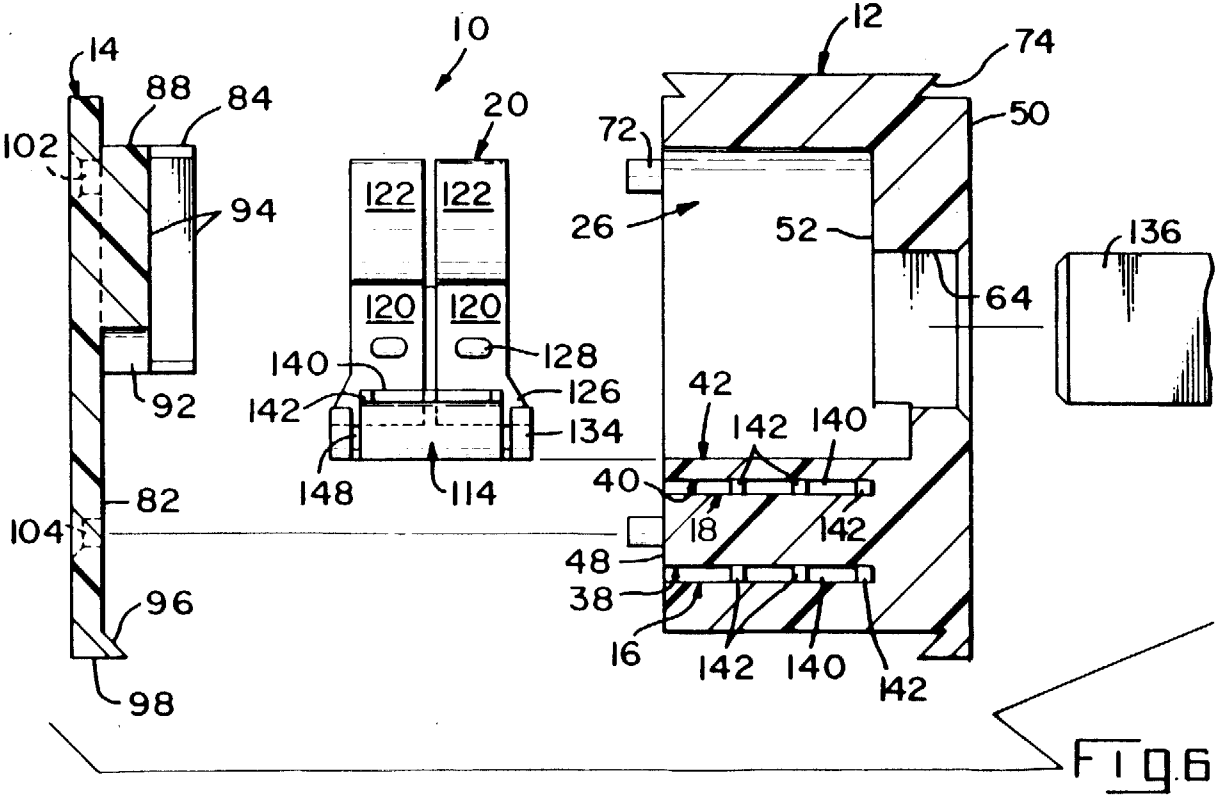
Figure 7:
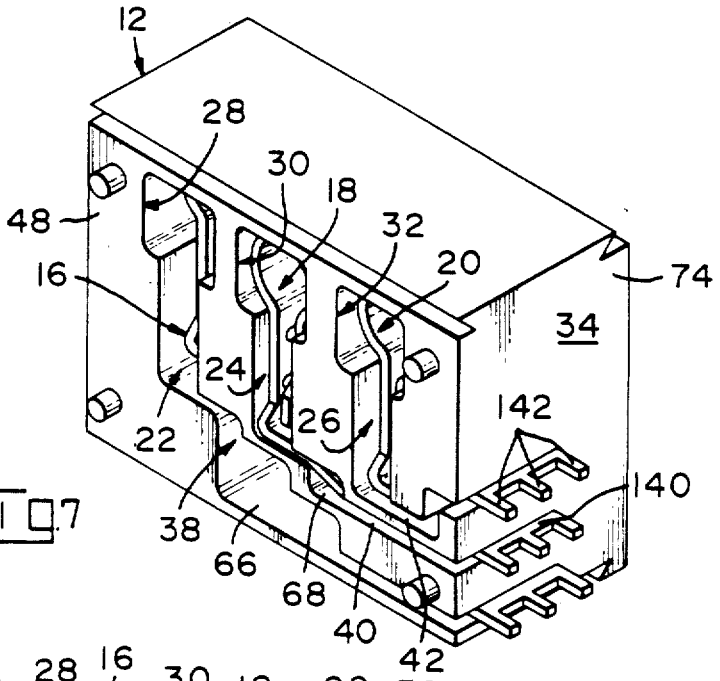
Figure 8:
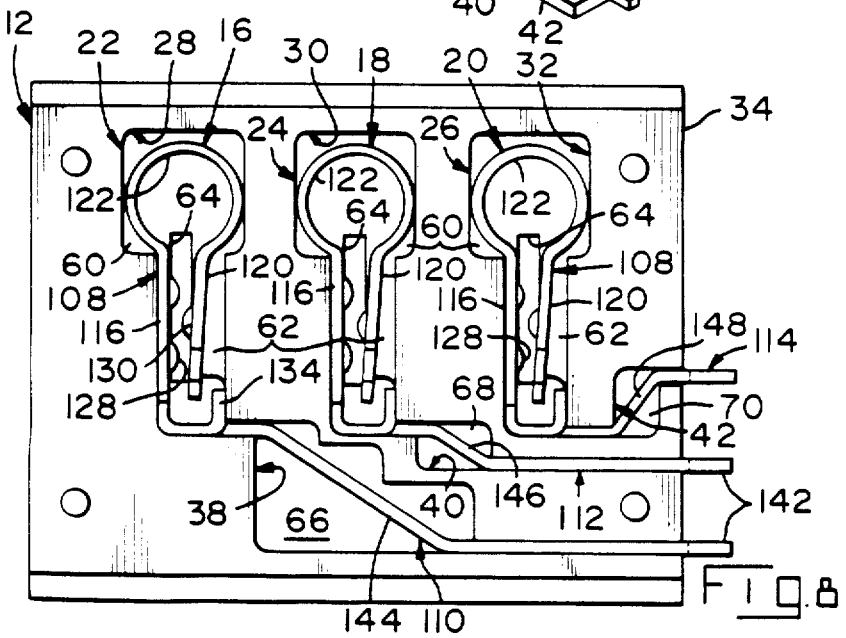
Figure 9:
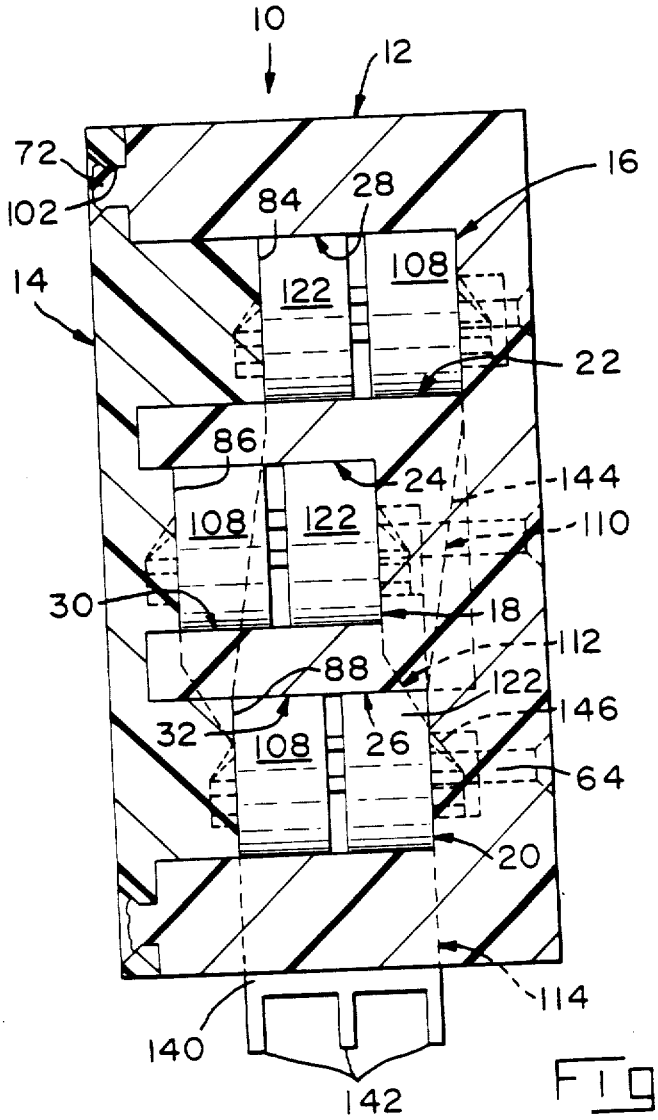

As shown in FIGS. 4A and 4B, spring members 122 are attached to member 116 at one end and members 120 at another end to support members 120 in front of and slightly inclined, i.e. preloaded, towards member 116.

Outer edges 124 flare out on members 120 to define ears 126.

Two parallel and spaced-apart contact surfaces 128 are provided on stationary member 116 and one contact surface 130 is provided on each member 120. As shown in the side view in FIG. 4A, contact surfaces 128, 130 project into space 132 between member 116 and members 120, and contact surface 130 is disposed between contact surfaces 128.

Tabs 134 project upwardly at each end of floor 118 on a side opposite stationary member 116. As shown, tabs 134 are on the outside of members 120 and in alignment with ears 126.

Figure 6:
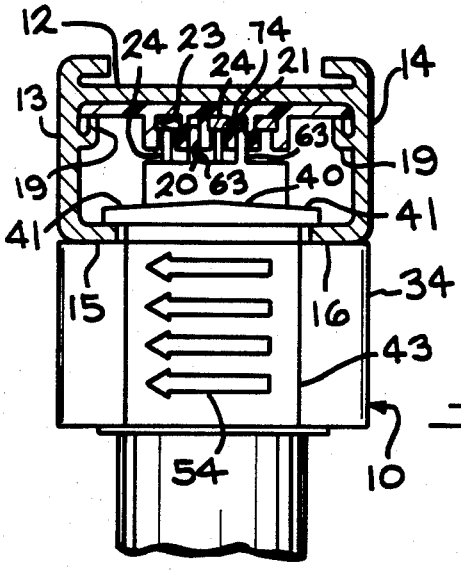
FIG. 6 is an exploded, side cross-sectional view of the electrical power connector.

The almost circular spring members 122 bias members 120 towards stationary member 116 so that a compressive force may be exerted against a tab terminal 136 (FIGS. 6, 10, 11) inserted therebetween.

The presence of two movable members 120 and associated spring members 122 provides an important advantage, which is that the total force required to insert terminal 136 into space 132 is divided into two smaller forces which are staggered relative to each other.

With reference to FIG. 1, straps 110, 112, 114 on respective elements 16, 18, 20 each include an inner section 138 which is identical in structure and, as shown in FIG. 4A, extend coplanarly from floor 118.

Each strap 110, 112, 114 also includes an outer section 140 having three pins 142 at the free end thereof. Pins 142 are identical in all respects while outer sections 140 differ with one another in length and orientation. Outer sections 140 are parallel with inner sections 138.

Intermediate sections 144, 146, 148 on straps 110, 112 and 114 respectively extend between and connect inner and outer sections 138, 140 and further displace outer section 140 relative to inner section 138. Intermediate section 144, relative to attached inner section 138, extends downwardly at an angle and slightly to the left. Intermediate section 146, relative to inner section 138 attached thereto, extends downwardly and to the right. Intermediate section 148, relative to inner section 138 attached thereto, extends upwardly at an angle and is in alignment therewith. As shown, intermediate section 144 is longest, intermediate section 148 is shortest in length, and intermediate section 146 is therebetween.

As noted above, cavities 22, 24, 26 and more particularly receptacle sections 28, 30, 32 extend into housing 12 to different depths. The offsetting configuration of intermediate sections 144 and 146 accommodates the differential positioning of receptacles 108 in receptacle sections 28, 30 so that outer sections 140 and pins 142 are in vertical alignment one with the other. As will be noted below, by staggering the location of receptacles 108, the force required to insert three tab terminals 136 simultaneously into connector 10 is spaced in time thereby resulting in a distributed insertion force.

Figure 5:
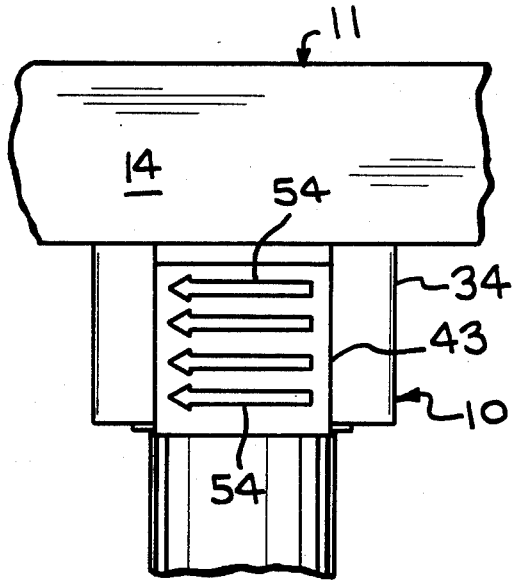
FIG. 5 is a top plan view of the contact element of FIGS. 4A and 4B after stamping but before being formed.

FIG. 5 shows contact element 18 after being stamped out but prior to being formed. The reference numerals used to identify the several members and sections of the formed element 18, e.g. as in FIG. 4A, are shown on the blank to provide a ready comparison.

In forming receptable section 108, members 120 and 122 are folded about fold lines 150 and 152. As shown in FIG. 4A, movable members 120 are bent beyond the vertical towards stationary member 116 to preload them. Stationary member 116 is folded up ninety degrees relative to floor 118 at fold line 154. Tabs 134 are folded up at fold lines 156 after folding members 120 into position.

Strap 112 is formed by folding along fold lines 158, 160 to the desired shape as shown in FIGS. 1 and 4A.

Contact elements 16, 18, 20 are positioned in respective cavities 22, 24, 26 from front surface 48 of housing 12. The cross-sectional views of FIGS. 3 and 6, along with FIG. 1, indicate the orientation of cover 14 and elements 16, 18, 20 with respect to housing 12 in assembling connector 10.

Figure 7:
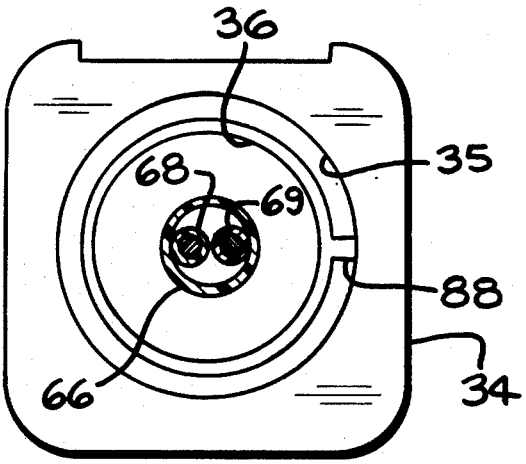
FIG. 7 is a perspective view of the housing with contact elements therein.
Figure 8:
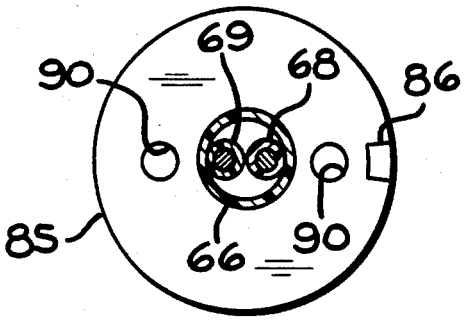
FIG. 8 is a front plan view of the housing with contact elements therein.

FIGS. 7 and 8 are views of housing 12 with contact elements 16, 18, 20 disposed in respective cavities 22, 24, 26. As shown, receptacle sections 28, 30, 32 are occupied by receptacles 108 with spring members 122 located in upper portions 60 and stationary member 116 and movable members 120 located in lower portions 62.

Straps 110, 112, 114 occupy respective passages 38, 40, 42 with intermediate sections 144, 146, 148 being accommodated in enlarged intermediate portions 66, 68, 70 respectively. Pins 142 uniformly project out from side 34 in vertical alignment.

FIGS. 9, 10 and 11 are views of assembled connector 10. After inserting elements 16, 18, 20 into respective cavities 22, 24, 26, cover 14 is secured to housing 12 by studs 72 on the latter being received in holes 102 in the former and deformed by heating.

As shown in FIG. 9, bosses 84, 86, 88 on cover 14 enter receptacle sections 28, 30, 32 respectively and bear against receptacles 108 therein. The presence of bosses 84, 86, 88 prevents contact elements 16, 18, 20 from moving as tab terminals 136 are inserted and withdrawn through passages 64.

FIG. 9 also shows, in phantom, intermediate sections 144 and 146 on straps 110 and 112 respectively. As noted above, intermediate sections 144 and 146 permit the staggered location of receptacles 108 in cavities 22, 24, 26 while maintaining outer sections 140 and more particularly pins 142 in a precise spatial location relative to each other.

FIG. 10, a cross-sectional side view of connector 10, shows tab terminal 136 inserted into receptacle 108 on contact element 20. Note that terminal 136 has entered groove 92 in boss 88 and abutted inside surface 82 on cover 14.

In entering receptacle 108, i.e. into space 132 between stationary member 116 and the two side-by-side movable members 120, the latter are biased away from the former with tabs 138 preventing overtravel by engaging ears 126 thereon if necessary, e.g. where the thickness of terminal 136 may be over tolerance.

Figure 10A:
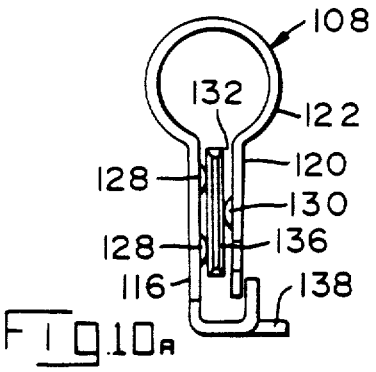
FIGS. 10A and 10B are views of contact elements and illustrating tab terminal placement therein.
Figure 10B:
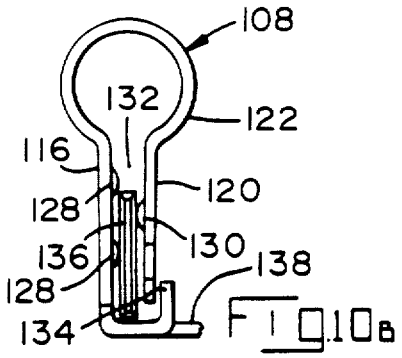

FIG. 10A, a view looking into receptacle 108, shows terminal 136 engaging contact surfaces 128 and 130 in the intended manner. FIG. 10B shows a terminal 136 which has been inserted such that it misses the upper contact surface 128 on member 116. Notwithstanding, terminal 136 is still adequately engaged electrically by the lower contact surface 128 and the two contact surfaces 130 on members 120. Other misaligned insertions would include terminal 136 entering on a cant (not shown). In this case, one member 120 would be biased out farther than the other. However, because the two movable members 120 and two spring members 122 are independently acting, terminal 136 would be accepted and effectively electrically engaged.

As shown in FIG. 11, like connectors 10 can be stacked together by keystone-shaped top portion 74 of one connector 10 being received in slot 80 of another like connector 10.

FIG. 11 illustrates one usage of connector 10. The environment depicted is in a device, e.g. a telephone switching system, wherein electronic components on a number of circuit cards 164, 166 are utilized. The cards 164, 166 would be mounted in a rack or card cage (not shown) with power being available from power bus bar 168 having tab terminals 136 mounted thereon in sets of three in rows (only a segment of bar 168 is shown).

Connectors 10 are mounted on cards 164, 166 with pins 142 being received and secured in holes 170, either by soldering or through an interference fit, to electrically engage conductive traces 172 thereon.

With reference to the left-hand side of the drawing in FIG. 11, one set of three connectors 10 with two being stacked together and the third exploded out therefrom, is shown. Pins 142 on the three connectors 10 are to be positioned in the three sets of nine holes 170 in circuit card 164. The spacing between sets of holes 170 is such that connectors 10 are stacked one directly on top of another.

Two sets of two connectors 10 each, shown on the right-hand side of the drawing, are mounted on circuit cards 166. Since the location of each set of nine holes 170 on cards 166 are spaced further apart than on card 164, spacer blocks 174 are required between connectors 10 in each set. Spacer blocks 174, made from a dielectric material such as glass-filled nylon, includes a keystone-shaped top portion 176 which is received in slot 80 on the bottom of a connector 10, and a keystone-shaped slot 178 which receives top portion 74 on a connector 10.

With circuit cards 164, 166 and associated connectors 10 being positioned in a rack or cage (not shown), bus bar 168, mounted on a movable panel or drawer (not shown) is moved adjacent connectors 10 for insertion of tab terminals 136 thereinto to energize cards 164, 166. As noted above, the staggered location of contact elements 16, 18, 20 and the two movable members 120 thereon distribute the force required to insert terminals 136 into receptacles 108. As will be appreciated by those skilled in the art, in the absence of a staggered arrangement, the insertion force would be substantial.

Figure 12:
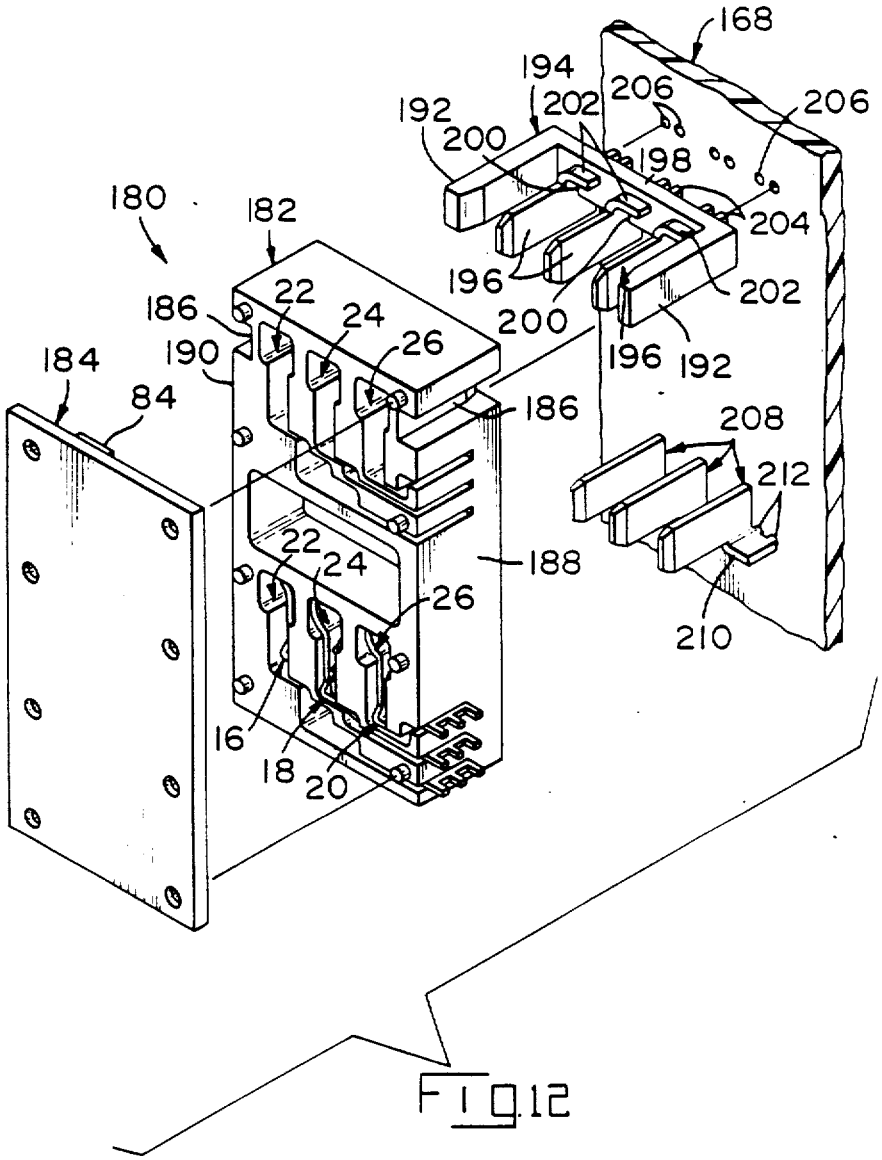
FIG. 12 is an exploded, perspective view showing an alternative embodiment of the electrical power connector.

FIG. 12 illustrates an alternative embodiment of the connector of the present invention. Connector 180 includes housing 182 having two spaced-apart sets of cavities 22, 24, 26, two sets of contact elements 16, 18, 20 which are received in respective cavities 22, 24, 26, and cover 184 having two space-apart sets of bosses 84, 86, 88. Further, laterally opened grooves 186 are provided on sides 188, 190 of housing 182 adjacent the upper set of cavities 22, 24, 26. Grooves 186 receive arms 192 on U-shaped bracket 194 positioned on a set of three tab terminals 196 when terminals 196 are inserted into connector 180.

Bracket 194 also includes bight 198 extending between and joining arms 192. Downwardly open slots 200 in bight 198 receive terminals 196 for mounting bracket 194 thereon. As shown, arms 192 are in line with and parallel to terminals 196. Tabs 202 on terminals 196 position bracket 194 thereon. Terminals 196 are mounted by pins 204 thereon in holes 206 on a bus bar 168.

Bracket 194, made from a dielectric material, functions as a terminal mounting means as well as an alignment means for aligning terminals 196 with respective passages 64 via arm 192 being received in grooves 186.

Terminals 208 shown below terminals 196 in FIG. 12 are receivable in connector 10 as well as connector 180 in either the top or bottom sets of cavities 22, 24, 26. Terminals 208 include a side member 210 having pins 212 thereon for being received in holes 206 on bus bar 168.

Terminals 136, 196 and 208 may be electrically commoned or isolated in the aforementioned sets of three as desired.

Connector 180 can include top portion 74 and slot 80 for stackability.

Connectors 10 and 180 have been depicted as having three or multiples of three contact elements 16, 18, 20 therein. It should be understood, however, that the invention contemplates connectors having one, two, or more than three contact elements therein, as warranted by the intended use thereof, without departing from the spirit of the invention. Similarly, pins 142 on contact elements 16, 18, 20 could be replaced by pins having compliant sections for interference fit in holes 170 on cards 164, 166 or surface mount configurations for cards having conductive pads in lieu of holes.

As noted above, the dual side-by-side spring-biased members 120 defining one side of tab terminal receiving space 132 divides the insertion force into two time-spaced increments. However, a single spring-biased member (not shown) would provide all the other advantages and accordingly would be within the contemplated scope of the invention.

As can be discerned, an electrial power connector has been disclosed which provides a means for transferring power from a bus bar to a circuit card. The connector includes a dielectric housing with a plurality of contact elements positioned therein in a staggered arrangement. Each contact element includes a receptacle for receiving a tab terminal on a power bus bar and terminal sections, e.g. pins, solder mount feet or the like, which electrically engage conductive traces on circuit cards. Each receptacle includes dual side-by-side movable members opposing a stationary member between which the terminal is received. The dual movable members and staggered arrangement of the contact elements cooperate to distribute the forces required to insert the tab terminals into the receptacles.

We claim:

1. An electrical power connector for conducting electrical power from a bus bar or like having tab terminal means to a circuit card, comprising:

dielectric housing means having a plurality of cavity means, openings to respective cavity means through one surface of said housing means and passages from respective cavity means to another surface of said housing means;

a plurality of conductive contact means with each having receptacle means disposed in respective said cavity means to receive tab terminal means inserted through said openings and circuit card engaging means disposed in respective said passages and projecting out through said another surface to engage the circuit card; and removable cover means covering said cavity means, said cover means having boss means protruding into respective cavity means to bear against and steady said receptacle means against moving as the tab terminal means are received thereinto, said boss means having groove means in alignment with said openings, said groove means adapted to receive the tab terminal means which extend through said receptacle means.

2. The electrical power connector of claim 1 wherein said circuit card engaging means include strap means attached to said receptacle means, said strap means on some of said contact means being displaced laterally with respect to said attached receptacle means.

* * * * *

UNITED STATES PATENT AND TRADEMARK OFFICE

CERTIFICATE OF CORRECTION

PATENT NO. : 4,671,584

DATED : June 9,1987

INVENTOR(S) : Lee Andrew Barkus et al.

It is certified that error appears in the above-identified patent and that said Letters Patent is hereby corrected as shown below:

The title page showing the illustrative figure should be deleted to appear as per attached title page.

The four (4) sheets of drawings should be deleted to be replaced with the ten (10) sheets of drawings as shown on the attached pages.

Signed and Sealed this

Twenty-second Day of December, 1987

*Attest:*

DONALD J. QUIGG

*Attesting Officer*

*Commissioner of Patents and Trademarks*

United States Patent [19]

Barkus et al.

[11] Patent Number: 4,671,584

[45] Date of Patent: Jun. 9, 1987

[54] ELECTRICAL POWER CONNECTOR

[75] Inventors: Lee A. Barkus, Millersburg; Matthew M. Sucheski, Harrisburg, both of Pa.

[73] Assignee: AMP Incorporated, Harrisburg, Pa.

[21] Appl. No.: 857,205

[22] Filed: Apr. 29, 1986

[51] Int. Cl.[4] ..... H01R 9/09; H01R 13/436; H01R 19/28

[52] U.S. Cl. ..... 439/78; 439/682; 439/844

[58] Field of Search ..... 339/17 C, 17 LC, 191 R, 339/191 M, 192 R, 192 RL, 258 R, 258 P, 258 F

[56] References Cited

U.S. PATENT DOCUMENTS

| | | | |
|---|---|---|---|
| 3,061,761 | 10/1962 | Blain | 361/413 |
| 3,192,498 | 6/1965 | Ruehlemann | 339/258 R |
| 3,470,421 | 9/1969 | Shore et al. | 339/17 L |
| 3,566,341 | 2/1971 | Skony | 339/192 RL |
| 4,030,792 | 6/1977 | Fuerst | 339/17 LC |
| 4,175,811 | 11/1979 | Coldren et al. | 339/191 M |
| 4,387,950 | 6/1983 | Guzik et al. | 339/17 LC |
| 4,451,107 | 5/1984 | Dola et al. | 339/143 R |
| 4,487,464 | 12/1984 | Kirschenbaum | 339/19 |

*Primary Examiner*—Neil Abrams
*Attorney, Agent, or Firm*—Allan B. Osborne

[57] ABSTRACT

An electrical power connector for conducting electrical power from a power bus bar to a circuit card. More particularly, the connector includes contact elements having tab terminal receiving receptacles positioned in a dielectric housing in a staggered arrangement so that the forces requires to insert tab terminals into the receptacles are distributed. Further, the terminal-receiving space in each receptacle is defined by a stationary member on one side and dual side-by-side spring-biased members on the other side so that the force required to insert a tab terminal therein is initially incremental.

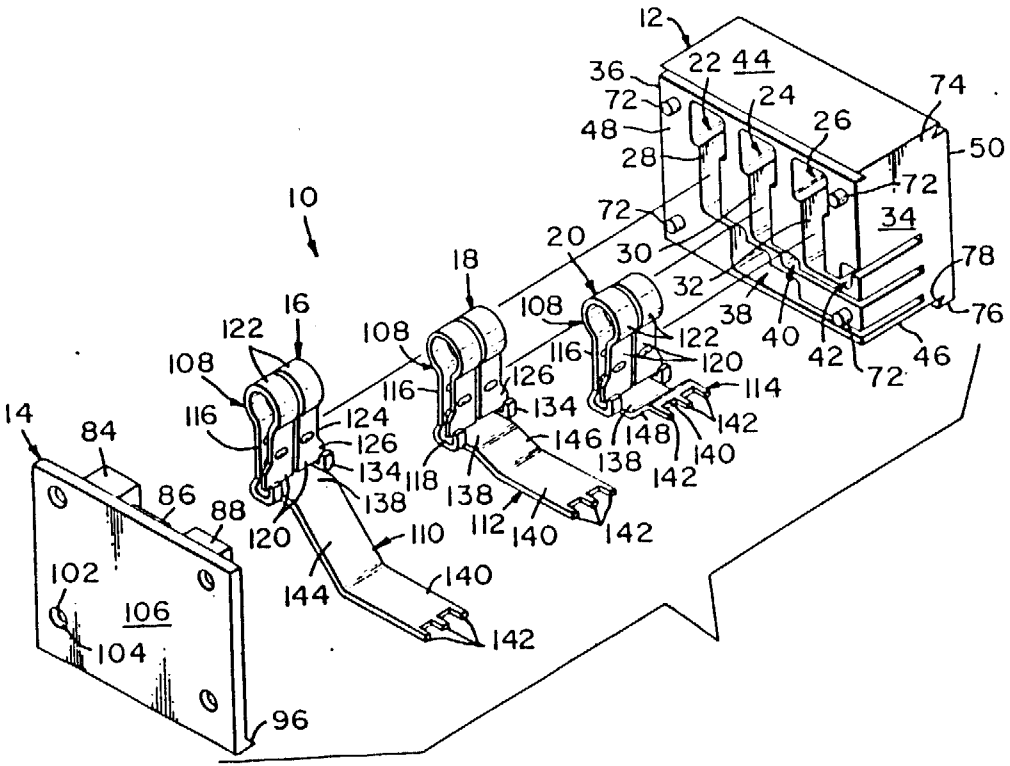

2 Claims, 16 Drawing Figures